US005366231A

United States Patent [19]

Hung

[11] Patent Number: 5,366,231

[45] Date of Patent: Nov. 22, 1994

[54] MOVABLE BASE FOR A BABY WALKER

[76] Inventor: Chin-Pin Hung, No. 58, Lane 200, Sec. 1, An-Ho Rd., Tainan City, Taiwan, Prov. of China

[21] Appl. No.: 200,473

[22] Filed: Feb. 23, 1994

Related U.S. Application Data

[63] Continuation-in-part of Ser. No. 60,728, May 12, 1993, abandoned.

[51] Int. Cl.[5] ..... B62B 9/08

[52] U.S. Cl. ..... 280/87.051; 280/43.14; 16/44; 297/5; 188/5

[58] Field of Search ..... 280/87.051, 43.14, 43.18; 188/5, 108, 109; 16/44; 482/66; 297/5

[56] References Cited

U.S. PATENT DOCUMENTS

| | | | |
|---|---|---|---|
| 1,949,163 | 2/1934 | Kasten et al. | 297/5 |
| 2,129,260 | 9/1938 | Bowser | 297/5 X |
| 2,613,289 | 10/1952 | Cramer | 16/44 |
| 2,765,839 | 10/1956 | Arpin | 280/87.051 |
| 2,945,242 | 7/1960 | Heiden | 188/5 |
| 2,995,355 | 8/1961 | Stump | 280/711 X |
| 3,096,536 | 7/1963 | Rabelos | 16/44 X |
| 3,216,048 | 11/1965 | Jespersen | 16/44 |
| 3,216,049 | 11/1965 | Nevison | 16/44 |
| 3,488,088 | 1/1970 | Goldberg et al. | 297/5 |
| 4,166,516 | 9/1979 | Thurmond, Jr. | 16/44 X |
| 4,699,392 | 10/1987 | Ku | 280/87.051 |
| 4,700,730 | 10/1987 | Samuelson et al. | 297/5 X |
| 4,740,005 | 4/1988 | Babin | 280/711 X |
| 5,001,808 | 3/1991 | Chung | 16/44 X |

FOREIGN PATENT DOCUMENTS

| | | | |
|---|---|---|---|
| 91045 | 2/1958 | Norway | 280/87.051 |

*Primary Examiner*—Brian L. Johnson
*Assistant Examiner*—Carla Mattix
*Attorney, Agent, or Firm*—Marshall & Melhorn

[57] ABSTRACT

A movable base for a baby walker includes a looped base frame, a number of casters, a corresponding number of compression spring members and a plurality of suction cup units. The base frame has a horizontal ring portion with an outer peripheral edge and a surrounding wall which extends downwardly from the outer peripheral edge. Each of the spring members has a first end connected to the ring portion and a second end connected to a respective one of the casters. The spring members are compressible so as to permit movement of the base frame between a first position, wherein the lowermost edge of the surrounding wall is located above the casters, and a second position, wherein the lowermost edge of the surrounding wall is in contact with the floor. Each of the suction cup units includes a shank portion that has a first end connected to the ring portion and a second end that is provided with a suction cup. The suction cup has a mouth that is disposed above the lowermost edge of the surrounding wall and is capable of gripping the floor when one of the casters ceases to contact the floor.

1 Claim, 9 Drawing Sheets

MOVABLE BASE FOR A BABY WALKER

CROSS-REFERENCE TO RELATED APPLICATION

This is a continuation-in-part application of U.S. patent application Ser. No. 08/060,728, filed on May 2, 1993, now abandoned.

BACKGROUND OF THE INVENTION

1. Field of the Invention

The invention relates to a baby walker, more particularly to a movable base for a baby walker.

2. Description of the Related Art

Referring to FIG. 1, a conventional height-adjustable baby walker 1 is shown to comprise a movable base with a looped base frame 10, a tubular frame 11, a top frame 12 and a seat portion 13. The base frame 10 is formed as an oval loop with an inverted U-shaped cross-section. The movable base further includes a plurality of universal casters 14 provided on the base frame 10 to permit movement of the base frame 10. Usually, about four casters 14 are mounted on the base frame 10 to ensure stability of the latter. The tubular frame 11 includes a spaced pair of tubular slide rails 111 which have two ends secured to an inner wall surface of the base frame 10 and which extend adjacent to respective opposite longer side walls of the base frame 10. The tubular frame 11 further includes a pair of U-shaped tubes 112, 113. The distal ends of a first one of the U-shaped tubes 112 are fixed to one of the ends of the slide rails 111 and are connected to the base frame 10. Each of the distal ends of a second one of the U-shaped tubes 113 is provided with a slide seat 114 that is movable slidably along a respective one of the slide rails 111. The vertical arms of the U-shaped tubes 112, 113 cross one another and are connected pivotally by means of a pivot joint 115. The top frame 12 is formed with an oval hole 121 and a tray 122 on a front side of the hole 121. The tray 122 has a bottom side that is supported on a horizontal portion of the first U-shaped tube 112. The seat portion 13 is secured on the top frame 12 and is suspended on two sides of the hole 121.

In use, a baby is seated on the seat portion 13 such that his legs extend therethrough. The position of the slide seats 114 on the slide rails 111 is then adjusted in order to adjust correspondingly the height of the top frame 12, thereby permitting the feet of the baby to rest firmly on the floor. The universal casters 14 permit movement of the baby walker 1 in any direction on the floor. When the baby becomes tired, his feet cease to rest firmly on the floor and his weight is supported by the seat portion 13, thereby permitting the baby to take a nap.

Note that the conventional baby walker 1 is dangerous to use when the floor is inclined. When the baby's feet cease to rest firmly on the floor, free rolling of the casters 14 occurs. This may result in overturning of the baby walker 1, thereby resulting in injuries to the baby.

In order to overcome this drawback, retractable spring-loaded casters, such as those disclosed in U.S. Pat. Nos. 2,613,389, 3,096,536, 3,216,048, 3,216,049 and 5,001,808, have been used to replace the universal casters 14. These casters generally comprise a tubular sleeve with a bottom end that is provided with a shield, and a wheel, such as a ball wheel, disposed in the sleeve and biased by a spring so as to be retractable within the shield. The shield may be cup-shaped or cylindricalshaped. The spring may be a coil spring or a bellows tube, as taught in U.S. Pat. Nos. 2,995,355 and 4,740,005.

When the feet of a baby seated on a conventional baby walker, which incorporates the spring-loaded casters, cease to rest firmly on the floor, the tubular sleeve of each caster moves downward and compresses the spring so that the lowermost edge of the shield contacts the floor to minimize free-rolling of the casters. Free-rolling of the casters, however, can still occur sometimes because the lowermost edge of the shield is smooth. Furthermore, it is also noted that these casters are relatively complicated in construction.

In a further modification of the conventional baby walker, suction cup units may be used with casters, as disclosed in U.S. Pat. No. 2,945,242, in order to grip the floor so as to anchor the baby walker. Thus, when the weight of a baby is applied on a conventional baby walker which incorporates the spring-loaded casters and at least one suction cup unit, the suction cup unit grips the floor when the shield of the casters contacts the latter. However, when the weight of the baby is removed from the baby walker, the expansion force of the spring is sometimes insufficient to overcome the suction force of the suction cup unit, thereby hindering movement of the baby using the baby walker.

It is also noted that when the conventional baby walker is used on an uneven floor surface, such as on a staircase, it is possible that one of the casters will cease to contact the floor if the baby walker was used carelessly, thereby causing the baby walker and the baby seated thereon to fall down the staircase.

Although baby walkers with anti-tipping devices, such as those disclosed in U.S. Pat. Nos. 2,765,839, 4,166,516 and 4,699,392 and in Norwegian Patent No. 91045, are known in the art, such devices are generally complicated in construction and provide inadequate protection to prevent toppling of the baby walker when used carelessly on a staircase.

SUMMARY OF THE INVENTION

Therefore, the objective of the present invention is to provide a movable base for a baby walker which can overcome the above mentioned drawbacks that are associated with the prior art.

More specifically, the objective of the present invention is to provide a movable base for a baby walker which is simple in construction and which can prevent effectively free-rolling thereof when in use.

Another objective of the present invention is to provide a movable base for a baby walker which incorporates suction cup units that grip the floor only when one of the casters cease to contact the floor to prevent the movable base from hindering movement of the baby using the baby walker while providing adequate protection to prevent toppling of the baby walker when used carelessly on a staircase.

Accordingly, the movable base of the present invention is to be used with a baby walker and comprises:

- a looped base frame having a horizontal ring portion with an outer peripheral edge and a surrounding wall which extends downwardly from the outer peripheral edge;
- a number of casters;
- a corresponding number of compression spring members, each of the spring members having a first end connected to the ring portion and a second end connected to a respective one of the casters, the spring members being compressible so as to permit movement of the base frame between a first position, wherein the lowermost edge of the surrounding wall is located above the casters, and a second position, wherein the lowermost edge of the surrounding wall is in contact with the floor; and a plurality of suction cup units, each of which including a shank portion that has a first end connected to the ring portion and a second end that is provided with a suction cup, the suction cup having a mouth that is disposed above the lowermost edge of the surrounding wall, the suction cup gripping the floor when one of the casters ceases to contact the floor, the suction cup units being disposed farther than the spring members and the casters from the surrounding wall.

BRIEF DESCRIPTION OF THE DRAWINGS

Other features and advantages of the present invention will become apparent in the following detailed description of the preferred embodiments, with reference to the accompanying drawings, of which.

DETAILED DESCRIPTION OF THE PREFERRED EMBODIMENTS

Figure 1:
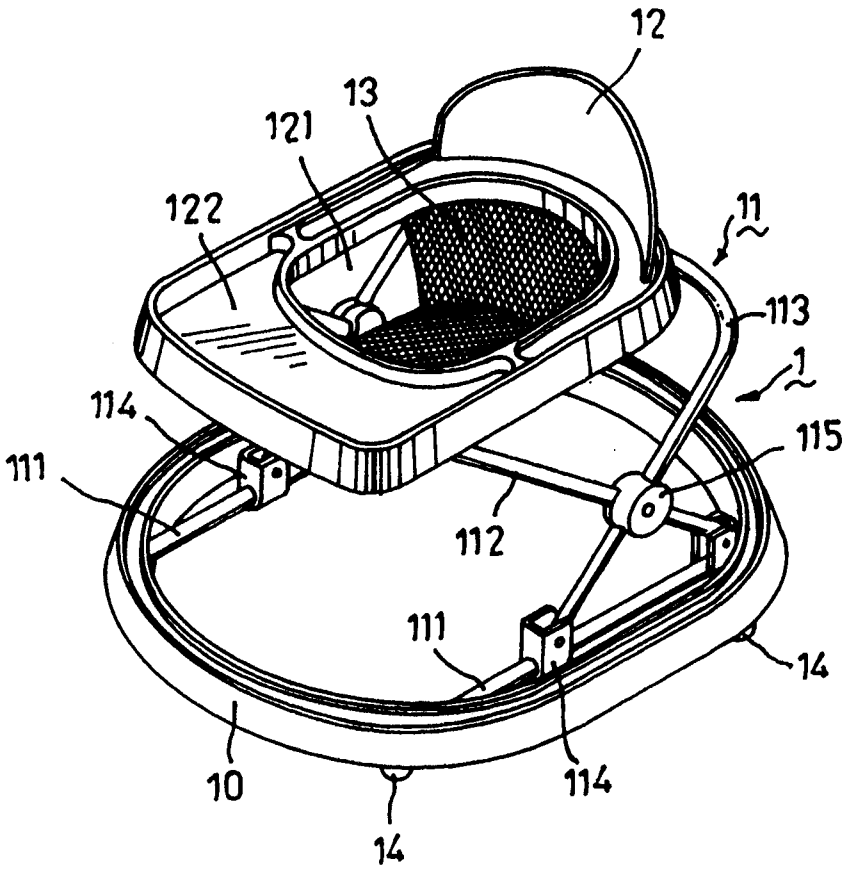
FIG. 1 PRIOR ART
FIG. 1 is a perspective view of a conventional baby walker.

Before the present invention is described in greater detail, it should be noted that like elements are denoted by the same reference numerals throughout the specification.

Figure 2:
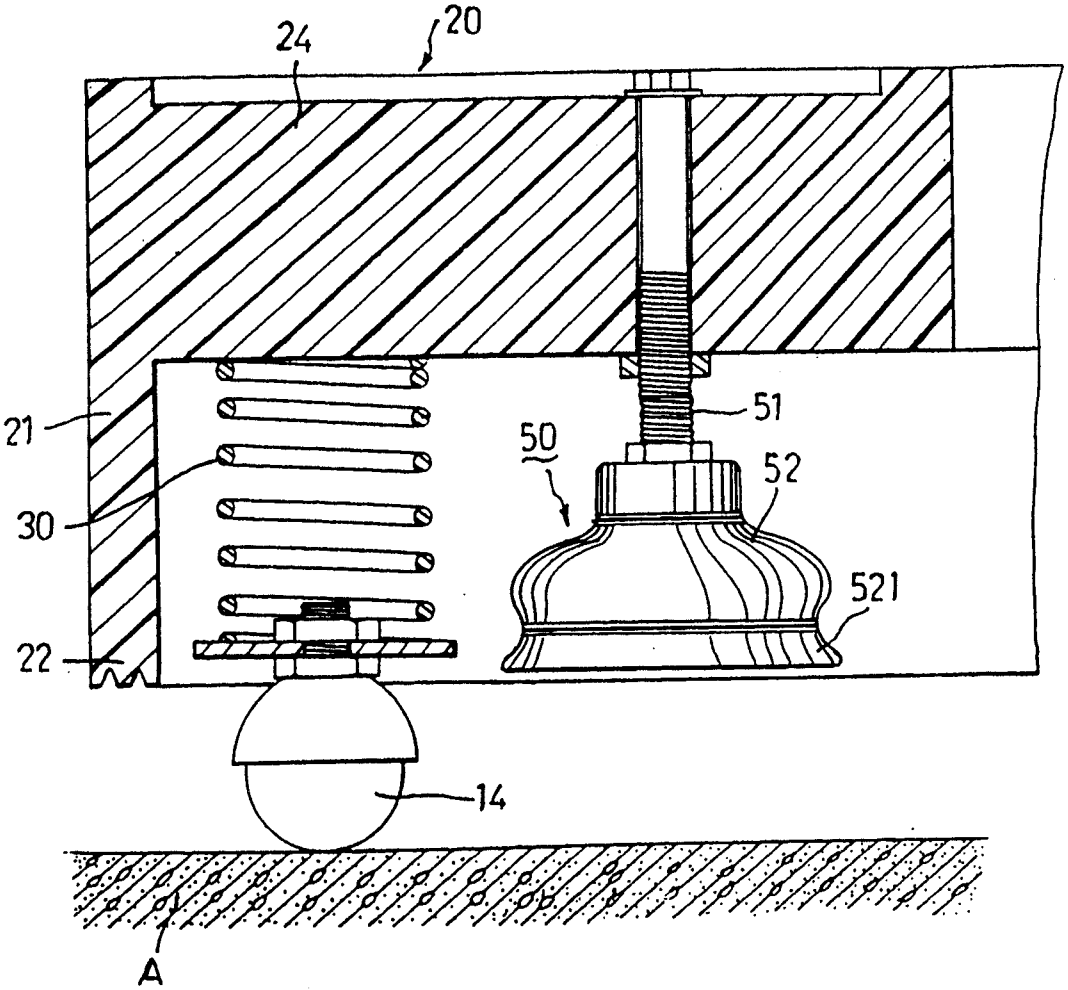
FIG. 2 is a sectional view of the first preferred embodiment of a movable base for a baby walker in accordance with the present invention.
Figure 4:
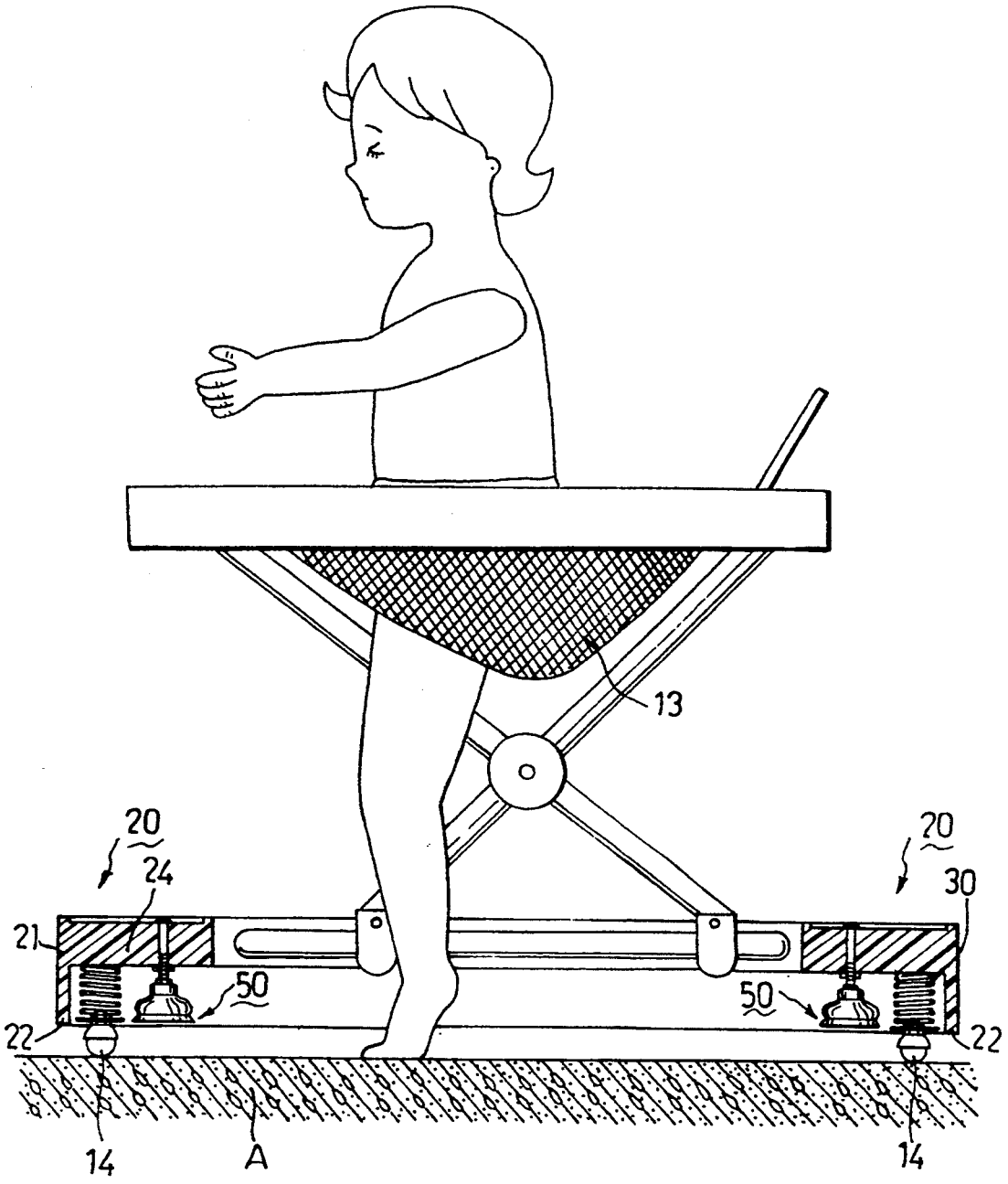
FIGS. 4 and 5 illustrate the first preferred embodiment when installed on a baby walker.

Referring to FIGS. 2 and 4, the first preferred embodiment of a movable base for a baby walker in accordance with the present invention is shown to comprise a looped base frame 20, a number of universal casters 14, a corresponding number of compression spring members 30, and a plurality of suction cup units 50.

The base frame 20 has a horizontal ring portion 24 and a surrounding wall 21 which extends downwardly from an outer peripheral edge of the ring portion 24. The surrounding wall 21 has a lowermost edge 22 which is formed with wedge-shaped teeth. In this embodiment, the spring members 30 are coil springs, each of which having a first end connected to the ring portion 24 and a second end supporting a respective one of the casters 14. Therefore, when the spring members 30 are in an uncompressed state, the lowermost edge 22 of the surrounding wall 21 is located above the casters 14 and is spaced from the floor (A), as shown in FIGS. 2 and 4.

Each of the suction cup units 50 includes a threaded shank 51 which has a first end that is retained threadably on the ring portion 24 and a second end that is provided with a suction cup 52. The suction cup 52 has a mouth 521 that is located above the lowermost edge 22 of the surrounding wall 21. In this embodiment, the number of suction cup units 50 corresponds with the number of casters 14. Each of the suction cup units 50 is disposed adjacent to a respective one of the casters 14 such that the casters 14 are disposed between the surrounding wall 21 and the respective one of the suction cup units 50. Thus, the suction cup units 50 are disposed farther than the spring members 30 and the casters 14 from the surrounding wall 21.

Figure 3:
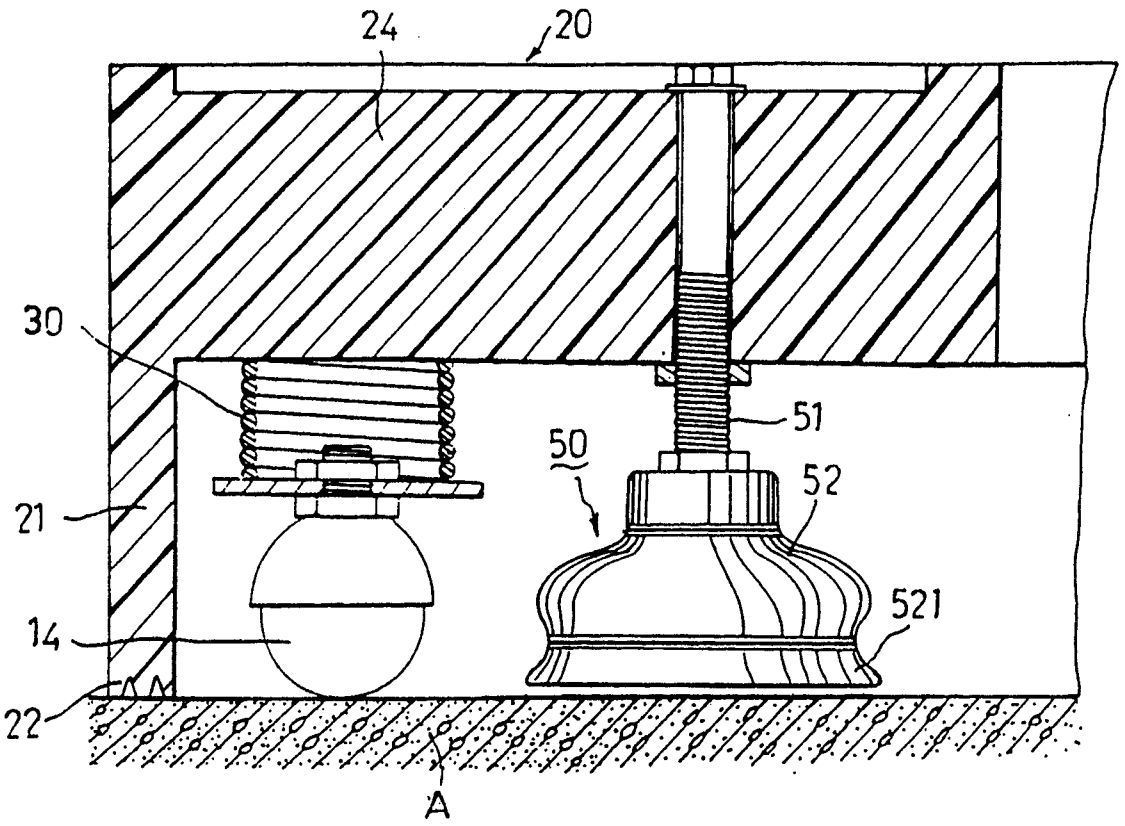
FIG. 3 is a sectional view of the first preferred embodiment when in a stationary state.
Figure 5:
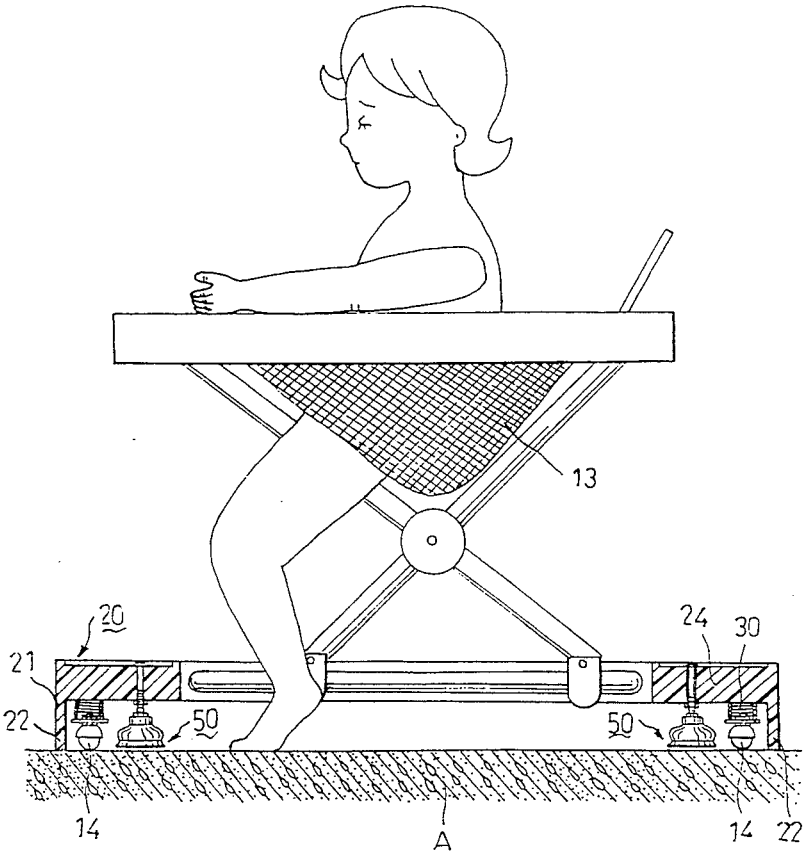

Referring to FIGS. 3 and 5, when a baby sits on the seat portion 13 of the baby walker, the base frame 20 moves downward so that the lowermost edge 22 of the surrounding wall 21 is in contact with the floor (A), thereby compressing the spring members 30. The wedge-shaped teeth on the lowermost edge 22 of the surrounding wall 21 enhance friction between the movable base and the floor (A), thereby preventing effectively free rolling of the casters 14 when the baby's feet do not rest firmly on the floor (A). At this time, the suction cup 52 of each suction cup unit 50 is not in contact with the floor (A), thereby preventing the suction cup units 50 from gripping the floor (A).

Referring again to FIGS. 2 and 4, when the baby stands so as to place his feet firmly on the floor (A), the spring members 30 expand to push the base frame 20 upward. The lowermost edge 22 of the surrounding wall 21 is once more spaced from the floor (A). Thus, the base frame 20 does not resist rolling movement of the casters 14 to facilitate movement of the baby walker which incorporates the movable base of the present invention. Since the suction cup units 50 do not grip the floor (A) when the weight of the baby is applied on the baby walker, the suction cup units 50 do not hinder movement of the baby using the baby walker.

Figure 6:
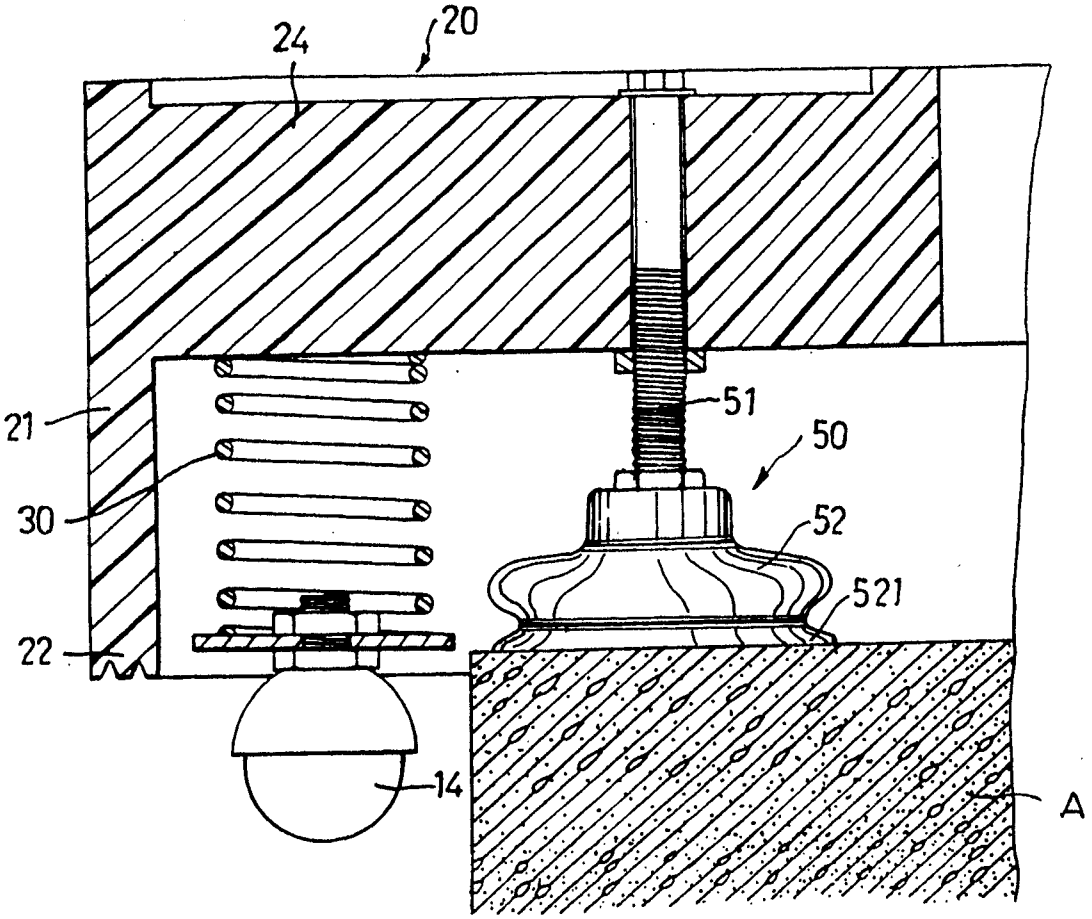
FIG. 6 illustrates the first preferred embodiment when used on a staircase, a suction cup unit of the first preferred embodiment gripping the floor to prevent toppling of the movable base.

Referring to FIG. 6, when the baby walker which incorporates the movable base of the present invention is used on an uneven floor surface, such as on a staircase, it is possible that one of the casters 14 will cease to contact the floor (A) if the baby walker was used carelessly. If this is the case, the suction cup 52 of at least one of the suction cup units 50 immediately grips the floor (A) so as to prevent toppling of the baby walker to prevent correspondingly injuries to the baby.

Note that the suction cup units 50 can be staggered relative to the casters 14, i.e. each of the suction cup units 50 can be disposed between two adjacent casters 14. In this case, the number of suction cup units 50 installed does not have to correspond with the number of casters 14.

Figure 7:
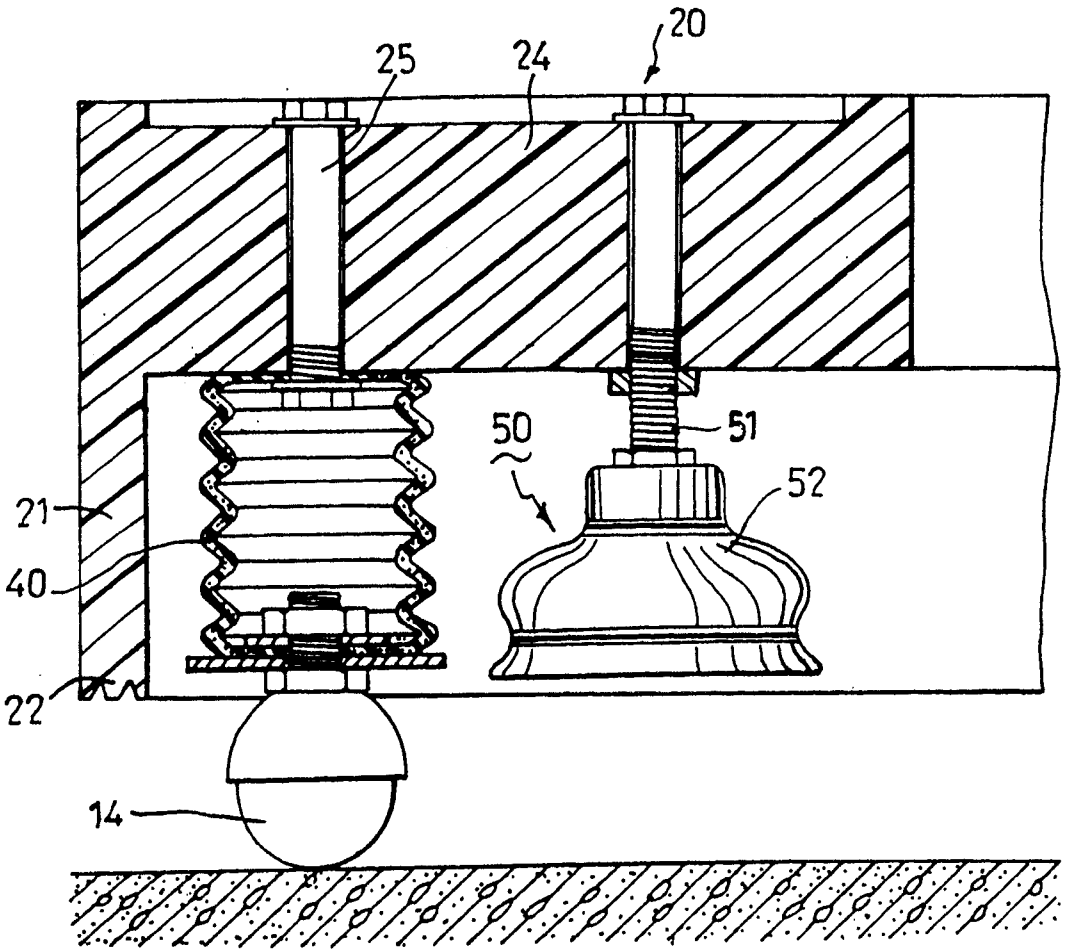
FIG. 7 is a sectional view of the second preferred embodiment of a movable base for a baby walker in accordance with the present invention.

FIG. 7 is a sectional view of the second preferred embodiment of a movable base for a baby walker in accordance with the present invention. The second preferred embodiment is substantially similar to the previous embodiment except that a number of bellows tubes 40 are used instead of coil springs. Each of the bellows tube 40 has a closed top end that is connected to the bottom surface of the ring portion 24 by means of a screw fastener 25 and a closed bottom end which supports a respective one of the casters 14.

Figure 8:
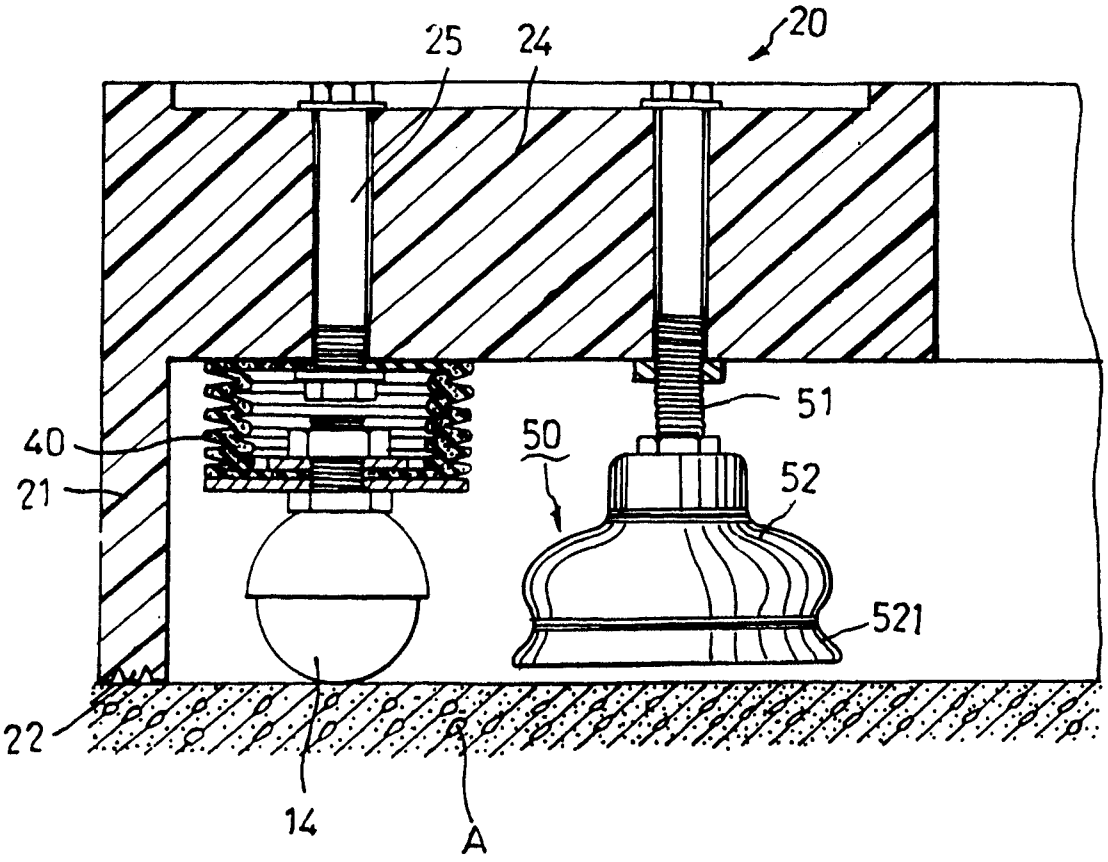
FIG. 8 is a sectional view of the second preferred embodiment when in a stationary state.

As with the previous embodiment, the bellows tubes 40 normally urge the base frame 20 upward so that the lowermost edge 22 of the surrounding wall 21 is spaced from the floor (A). When the weight of the baby is applied on the baby walker, the base frame 20 moves downward so that the lowermost edge 22 of the surrounding wall 21 is in contact with the floor (A), thereby compressing the bellows tubes 40, as shown in FIG. 8. When the weight of the baby is removed from the baby walker, the bellows tubes 40 expand to push the base frame 20 upward. The lowermost edge 22 of the surrounding wall 21 is once more spaced from the floor (A), as shown in FIG. 7.

Figure 9:
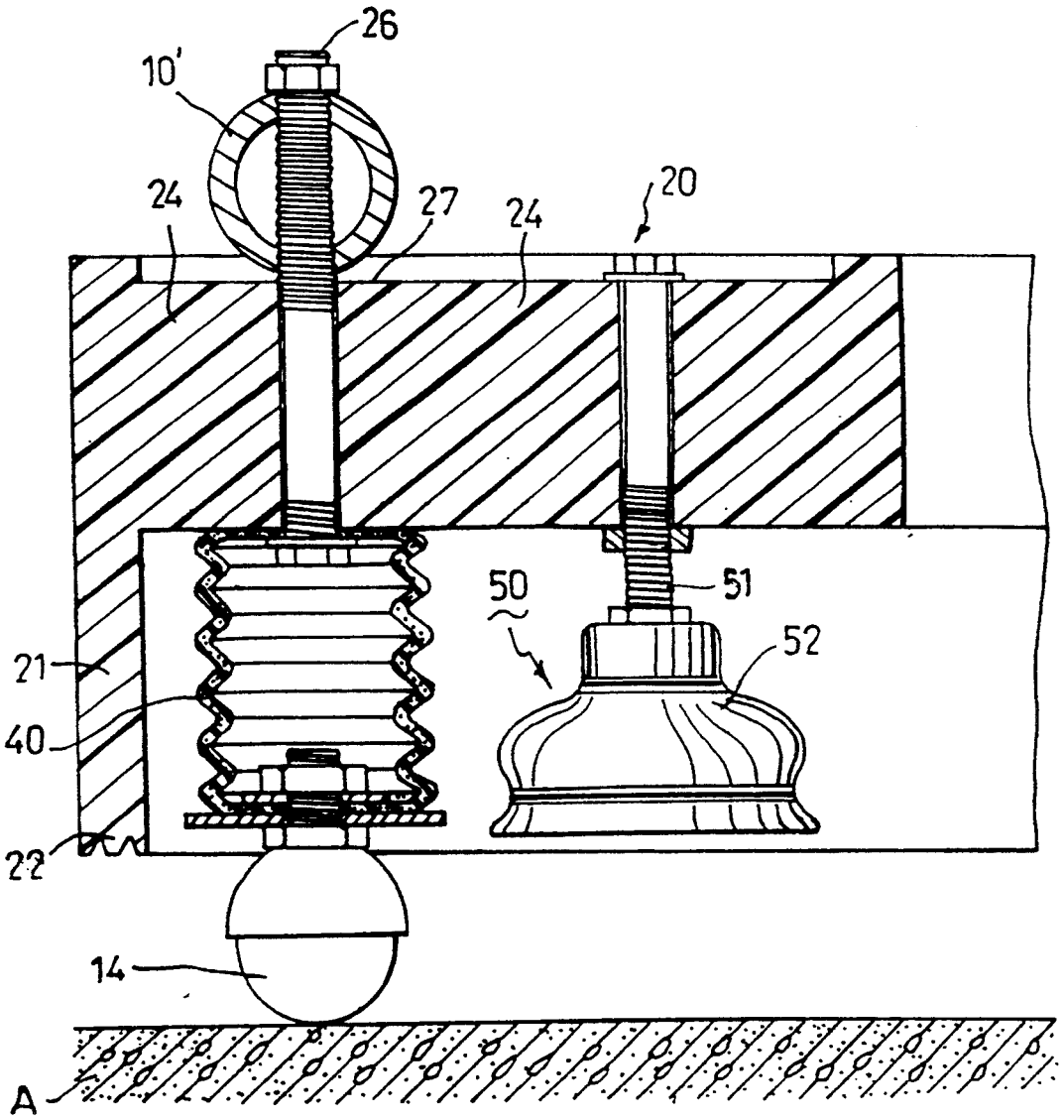
FIG. 9 is a sectional view which illustrates the second preferred embodiment when mounted on a tubular ring base of a conventional baby walker.

The movable base of the present invention can be secured on a tubular ring base of another conventional baby walker. Referring to FIG. 9, the movable base of the second preferred embodiment is secured on a tubular ring base 10' of a conventional baby walker by means of screw fasteners 26 (only one screw fastener 26 is shown). Each of the screw fasteners 26 extends through the closed top end of a corresponding one of the bellows tubes 40, the ring portion 24 and the tubular ring base 10', thereby connecting the bellows tubes 40 and the tubular ring base 10' to the ring portion 24 of the base frame 20.

It has thus been shown that the movable base of the present invention is simple in construction and can prevent effectively free-rolling thereof when in use due to the teethed lowermost edge 22 of the surrounding wall 21. Furthermore, the suction cup units 50 of the movable base grip the floor (A) only when one of the casters 14 cease to contact the floor (A) to prevent the movable base from hindering movement of the baby using the baby walker while providing adequate protection to prevent toppling of the baby walker when used carelessly on a staircase. The objectives of the present invention have thus been achieved.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A movable base for a baby walker, comprising:

a looped base frame having a horizontal ring portion with an outer peripheral edge and a surrounding wall which extends downwardly from the outer peripheral edge;

a number of casters;

a corresponding number of compression spring members, each of said spring members having a first end connected to the ring portion of said base frame and a second end connected to a respective one of said casters, said spring members being compressible so as to permit movement of said base frame between a first position, wherein the lowermost edge of said surrounding wall is located above said casters, and a second position, wherein said lowermost edge of said surrounding wall is in contact with the floor; and a corresponding number of suction cup units, each of said suction cup units being disposed adjacent to a respective one of said casters such that said casters are disposed between the surrounding wall of said base frame and the respective one of said suction cup units, each of said suction cup units including a shank portion having a first end connected to the ring portion of said base frame and a second end that is provided with a suction cup, the suction cup having a mount disposed above the lowermost edge of the surrounding wall of said base frame, the suction cup gripping the floor when one of said casters ceases to contact the floor, said suction up units being disposed farther than said spring members and said casters from the surrounding wall of said base frame.

* * * * *